US007743723B2

(12) United States Patent
Verkooijen et al.

(10) Patent No.: US 7,743,723 B2
(45) Date of Patent: Jun. 29, 2010

(54) DAVIT ASSEMBLY AND A METHOD FOR MOVING A BOAT

(75) Inventors: Andreas Adrianus Verkooijen, Heiloo (NL); Hugo Maurits Van Wieringen, Heemstede (NL)

(73) Assignee: Azure Naval Architects B.V., VK Haarlem (NL)

( * ) Notice: Subject to any disclaimer, the term of this patent is extended or adjusted under 35 U.S.C. 154(b) by 15 days.

(21) Appl. No.: 11/988,568

(22) PCT Filed: Jul. 21, 2005

(86) PCT No.: PCT/EP2005/053555

§ 371 (c)(1),
(2), (4) Date: Mar. 5, 2008

(87) PCT Pub. No.: WO2007/009494

PCT Pub. Date: Jan. 25, 2007

(65) Prior Publication Data

US 2009/0050046 A1 Feb. 26, 2009

(51) Int. Cl.

| | |
|---|---|
| ***B63B 23/00*** | (2006.01) |
| ***B63B 23/02*** | (2006.01) |
| ***B63B 23/18*** | (2006.01) |
| ***B63B 23/26*** | (2006.01) |

(52) U.S. Cl. ..... 114/369; 114/373; 114/374

(58) Field of Classification Search ..... 114/368–374; 414/137.7, 137.8, 139.4, 140.4, 141.4–141.6, 414/142.7

See application file for complete search history.

(56) References Cited

U.S. PATENT DOCUMENTS 3,661,416 A 5/1972 Bukarkin et al.

FOREIGN PATENT DOCUMENTS

| | | | |
|---|---|---|---|
| GB | 131727 | | 8/1919 |
| GB | 186282 | | 9/1922 |
| GB | 607313 | | 8/1948 |
| JP | 52152061 | A * | 12/1977 |
| JP | 61235291 | A * | 10/1986 |
| JP | 01226695 | A * | 9/1989 |
| JP | 04269209 | A * | 9/1992 |
| JP | 2000063087 | A * | 2/2000 |
| WO | WO 01/51348 | | 7/2001 |

* cited by examiner

*Primary Examiner*—Ajay Vasudeva
(74) *Attorney, Agent, or Firm*—Harness, Dickey & Pierce, PLC

(57) ABSTRACT

An onboard davit assembly for launching a boat from a ship is disclosed. In at least one embodiment, the assembly includes two spaced apart davits, each davit including a substantially horizontal boom, a hoist cable extending downwards from a suspension frame on the boom and including at least one fixation device at its lower end to which the boat can be attached. In at least one embodiment, the assembly is arranged such that the booms are movable between an inward position wherein the suspension frames extend inboard and an outward position wherein the suspension frames extend outboard, wherein the booms extend from an onboard vertical pivot axis and can rotate in a horizontal plane around the pivot axis, and wherein the suspension frames are movable along the booms such that a distance between the suspension frames remains constant during rotation of the booms between the two positions when the boat is moved from a parking position to a launching position.

8 Claims, 6 Drawing Sheets

DAVIT ASSEMBLY AND A METHOD FOR MOVING A BOAT

BACKGROUND

1. Field

The invention relates to an onboard davit assembly for launching a boat or the like from a ship, comprising two spaced apart davits, each davit comprising a substantially horizontal boom, a hoist cable extending downwards from a suspension frame on said boom and having fixation means at its lower end to which the boat can be attached, wherein the assembly is arranged such that the booms are movable between an inward position wherein the suspension frames extend inboard and an outward position wherein the suspension frames extend outboard. Where the current invention is described as an onboard davit assembly for launching a boat from a ship, this is to be understood to comprise davit assemblies for onshore purposes as well. The term ship can in this respect be replaced by quay or wharf, and the term onboard can in this respect be replaced by onshore, throughout the description and the claims.

2. Description of the Related Art

Such a davit assembly is described in WO 01/51348. The booms of the known davit assembly are parallel telescopic booms which can be extended and retracted between the two positions. It is however difficult to provide a reliable connection between the fixed part and the telescoped part of the telescoping booms in the telescoped position, such that the boom will not break when the boat is suspended outboard. This requires either a very strong and thereby heavy construction, or a large overlap between the telescoping part and the fixed part. In the latter case the telescoping boom must be substantially longer than the width of the boat to be launched, and such a construction thereby takes much extra room of the ship. Although in some cases it is possible to contain the extra (overlapping) length of the boom in an unused space or compartment of the ship, it is in any case an obstacle that must be taken into account.

SUMMARY

It is an object of the invention to provide a safe, reliable, low-cost, compact, lightweight davit assembly, which can be easily integrated in a ship's design and which can be easily installed and used.

According to the invention the booms extend from an onboard vertical pivot axis and can rotate in a horizontal plane around said pivot axis, and the suspension frames are movable along the booms such that the distance between the suspension frames remains constant during rotation of the booms between said two positions when the boat is moved from the parking position to the launching position.

In a preferred embodiment said booms and suspension frames are mutually coupled through synchronization means such that the suspension frames move in a parallel manner. In the preferred embodiment both booms can rotate at substantially the same time in opposite directions in a more or less mirrored fashion. Because the boat does not need to be suspended from the two davits at the same location along the two booms, the speed and outer angles of rotation of both booms may differ. The distance between the vertical pivot axes of the davits and the side of the ship where the boat is launched can be smaller than the distance between the centre of the parking position of the boat and said side of the ship. Said pivot axes can even be located at the very side of the ship.

Each boom is preferably rotatable by a motor having a driving shaft, which is coaxial with the pivot axis. Alternatively the rotation of the boom can be achieved by means of a ram, for instance a hydraulic ram.

Preferably each boom is connected to an upright, wherein at least the part of the upright to which the boom is connected can be rotated. Each suspension frame is preferably movable by a motor driving a belt, which belt is connected to the suspension frame. Said motor is preferably contained in the rotatable part of the upright.

The hoist cable is preferably fixed at one end near the outer end of the boom and is wound on an onboard reel at its other end. A central part of the hoist cable is then suspended from the suspension frame in a U-shape, and the fixation means comprise a sheave supporting on the bottom of said U-shaped part of the cable.

The suspension frame preferably comprises two sheaves from which the hoist cable is suspended. The suspension frame further preferably comprises two pairs of running wheels, which run on two parallel running surfaces that are present on the boom. The hoist cable is preferably guided from the suspension frame to the pivoting axis of the boom by a sheave fixed to said pivoting boom, and from there along said pivoting axis to a non-pivoting sheave.

The invention also relates to a method for moving a boat or other object, wherein two spaced apart davits are used, each davit comprising a substantially horizontal boom, wherein a hoist cable extends downwards from a suspension frame on said boom and has fixation means at its lower end to which the boat or other object is attached, wherein the booms are moved between a first position and a second position, whereby the boat or other object is moved from a corresponding first position to a corresponding second position, wherein the booms extend from an onboard vertical pivot axis and are rotated in a horizontal plane around said pivot axis between the first position and the second position, and wherein during said rotation the suspension frames are moved along the booms and the distance between the suspension frames is kept constant.

BRIEF DESCRIPTION OF THE DRAWINGS

The invention will be illustrated by means of an exemplary embodiment with reference to the drawings, in which.

DETAILED DESCRIPTION OF EXAMPLE EMBODIMENTS

Figure 1:
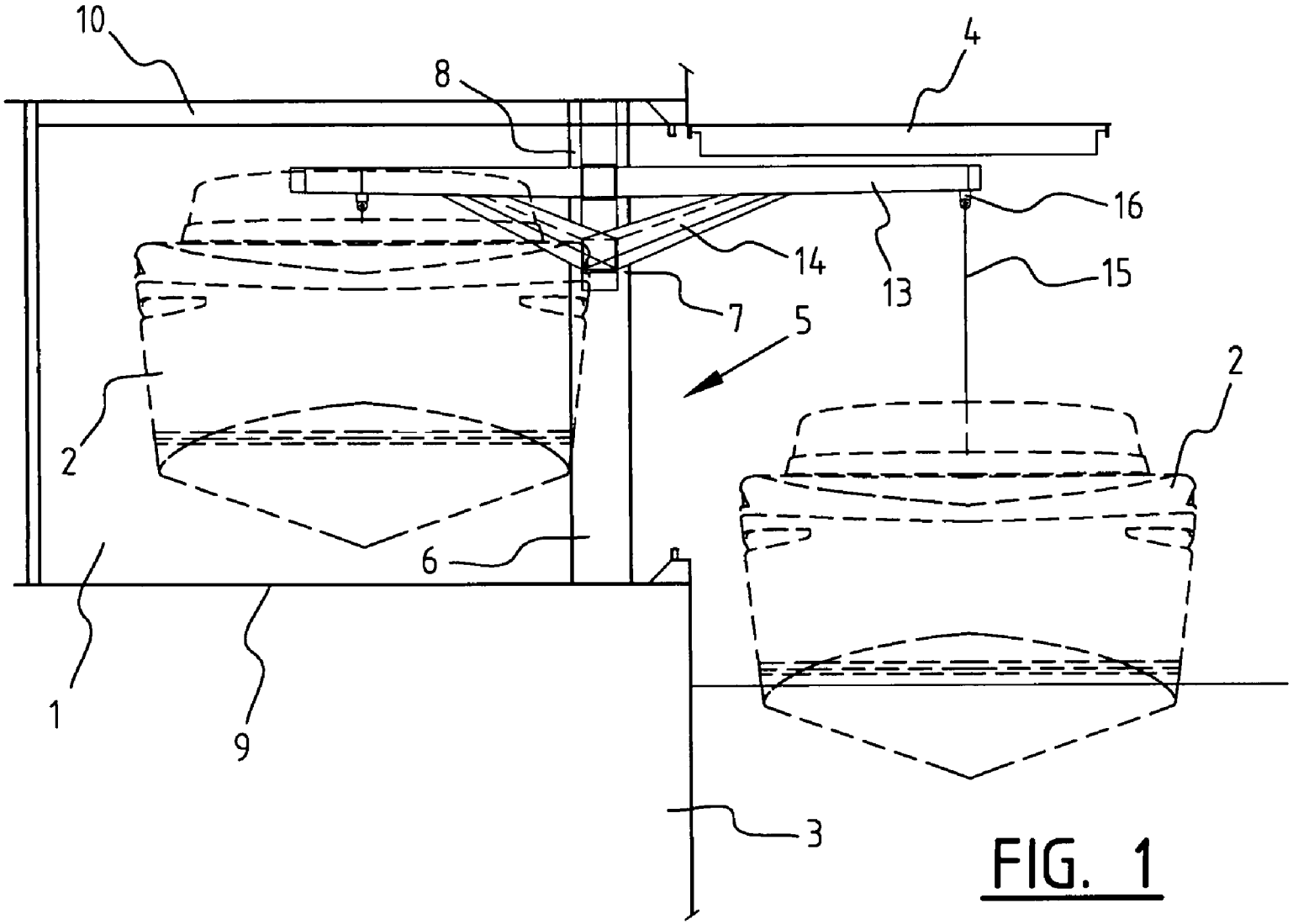
FIG. 1 schematically shows a davit assembly for launching a boat in side view, with the boat shown in broken lines once in parking position and once in launching position.
Figure 2A:
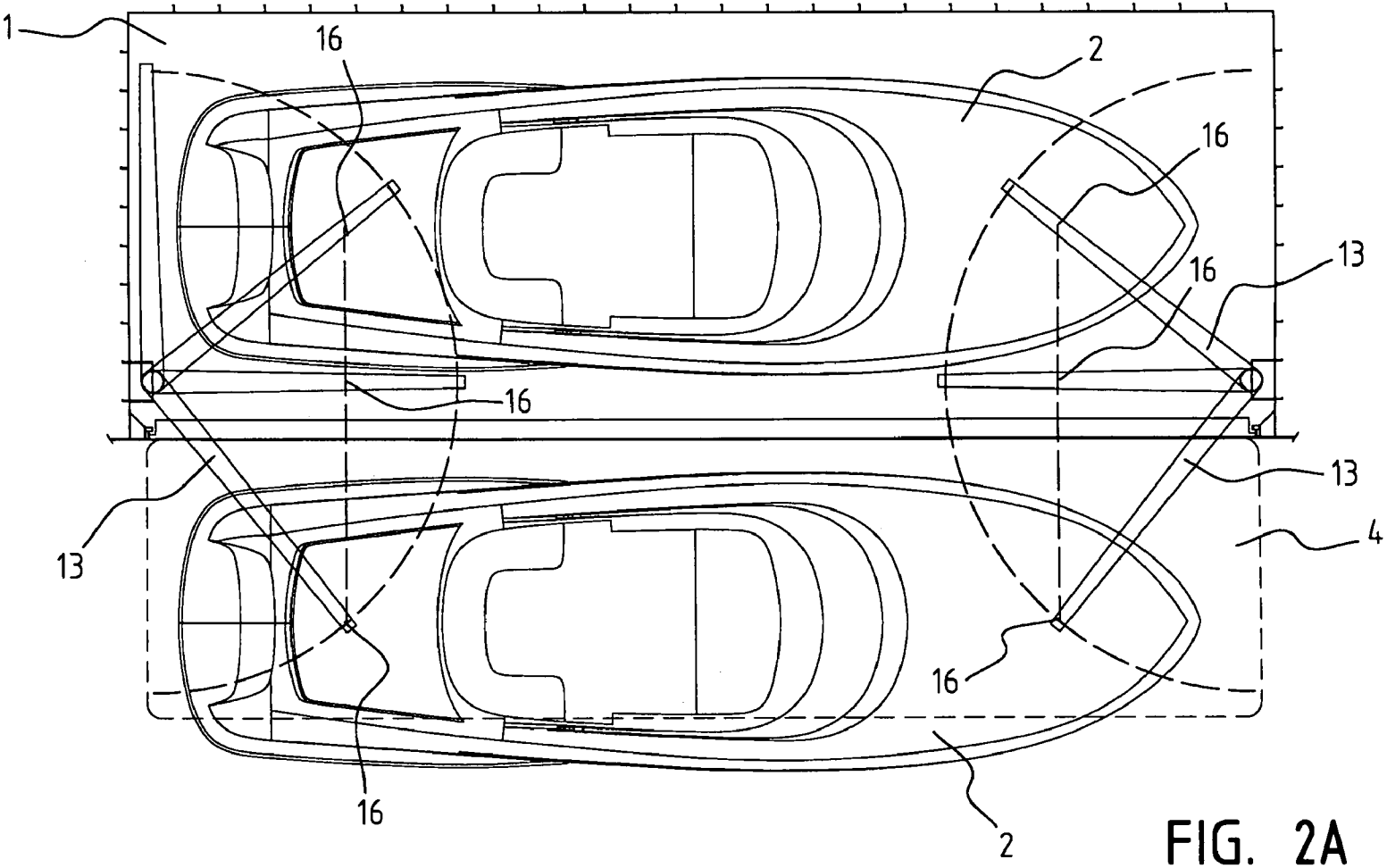
FIG. 2A schematically shows the assembly of FIG. 1 in top view, in three different working positions while launching the boat.

According to FIGS. 1 and 2A a hold 1 for keeping a boat 2 is provided adjacent the outer side of a ship 3, wherein a hinged hatch 4 in the wall of the ship gives access to the hold 1 and the boat 2 therein. The boat 2 can be launched while the hatch 4 is in the open position as shown.

A davit assembly is provided near the outer side of the hold 1, and comprises two vertical hollow uprights 5. The uprights 5 each comprise three parts, a lower stationary part 6 rigidly connected to the deck 9 of the hold 1, a middle rotating part 7, and an upper stationary part 8 which is rigidly connected to the overhead deck 10 of the hold 1. The rotating part 7 is located in the top half of the upright 5 and is connected between the stationary parts 7, 9 by means of bearings 11, 12 (see FIG. 3). Each upright 5 has a horizontal hollow boom 13 extending from its rotating part 7. The connection between the horizontal boom 13 and the rotating part 7 is reinforced by a diagonal connection element 14 between the two (which is however preferably smaller than shown in FIG. 1).

A hoist cable 15, which can be lowered and retracted, extends from a suspension frame 16 which can be moved along the length of the boom 13. The lower end of the hoist cable 15 comprises a hoist block 17 which can be attached to the boat 2 in any known manner.

FIG. 2A shows in three working stages how the booms 13 are rotated around the axes of the uprights 5 while the suspension frame 16 and the hoist cable 15 move along the length of said booms 16 (the boat 2 is only shown in the parking position and the launching position). The booms 13 are both generally extending from the uprights 5 inwardly towards each other. More precisely, they are movable between an inboard parking position where they both include a first (negative) sharp angle with the plane through the uprights 5, and an outboard launching position where they both include an second (positive) sharp angle with said plane. About midway during said rotation the two booms 13 point towards each other. Thus the booms 13 simultaneously rotate in a mirrored manner, the mirror plane being the centre plane that is perpendicular to the plane through the uprights 5.

During said rotation the suspension frame 16 on both booms 13 is moved from a first outer position when the booms 13 are in the inboard position, towards an inner position at the moment that the booms 13 point towards each other, and then back to a second outer position when the booms 13 are in the outboard position. The movement of the suspension frame 16 along the boom 13 is synchronized with the rotation of the boom 13 around the upright 5 such that both suspension frames 16 and hoist blocks 17 (see FIG. 3) move in substantially straight and mutually parallel lines (seen from above). It will be appreciated that the position of the suspension frame 16 on the boom 13 should be a sine-function of the rotational angle of the boom 13. The boat 2 that is attached to the hoist blocks 17 is thereby transversely moved in a straight line from the inboard parking position to the outboard launching position.

Figure 3:
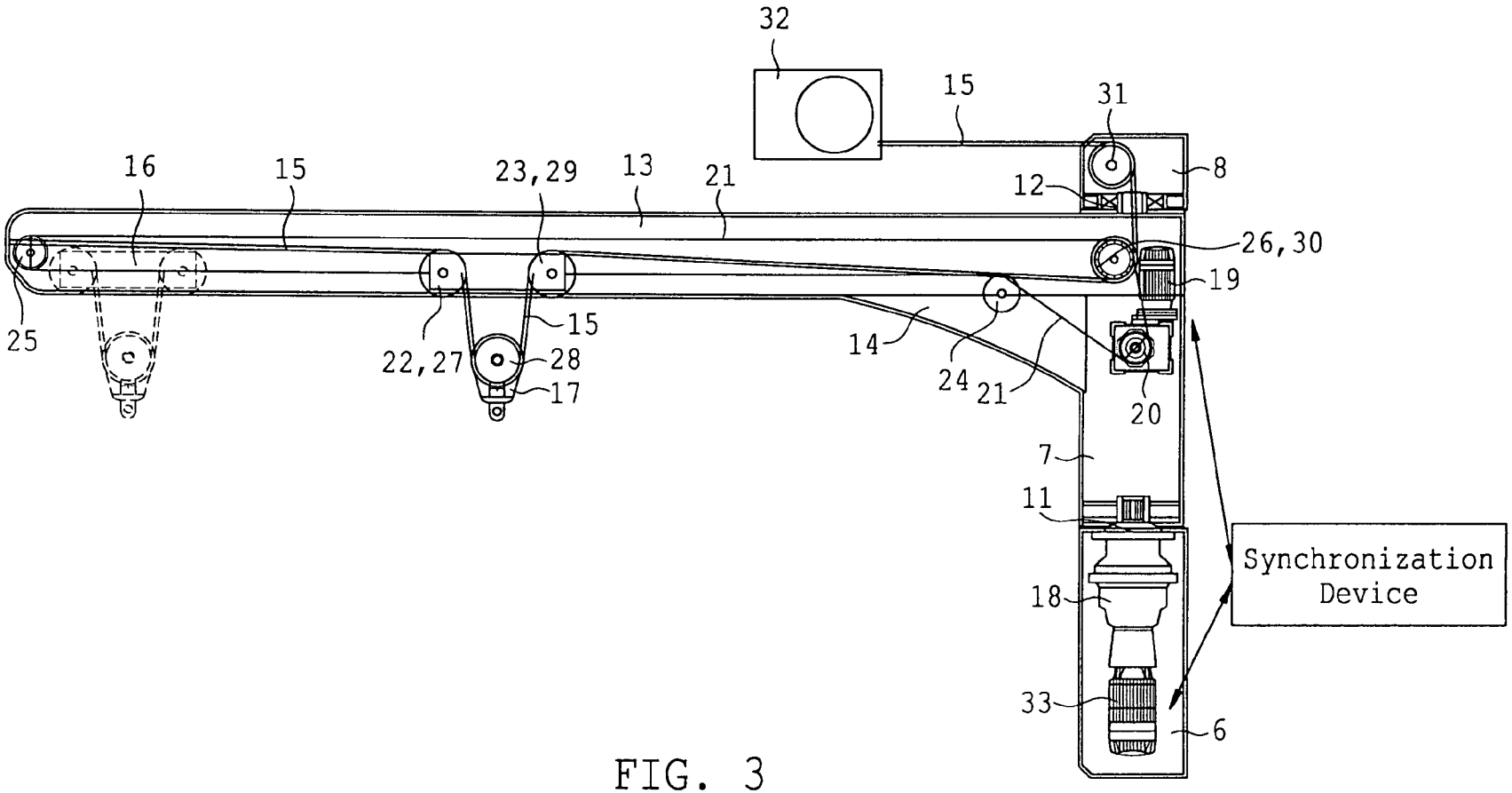
FIG. 3 schematically shows the davit assembly of FIG. 1 in a more detailed side view.
Figure 4:
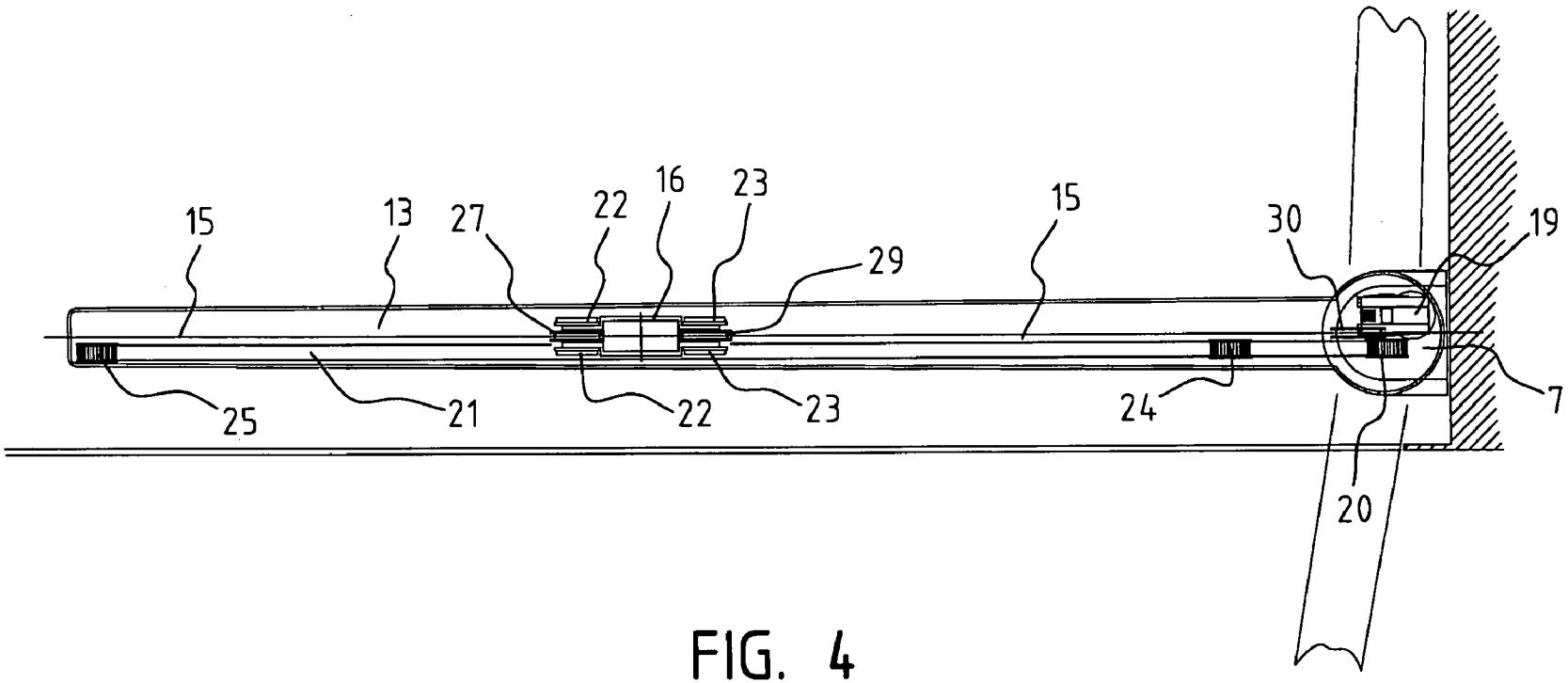
FIG. 4 schematically shows the davit assembly of FIG. 1 in a more detailed-top view.

In theory it would be possible to let the suspension frames 16 move freely along the booms 13, because the downward forces of the hoists 5 will cause them to follow the paths as shown when the booms 13 are rotated. In the preferred embodiment however (for instance in the embodiment as shown in FIGS. 3 and 4), the suspension frames 16 are moved in a controllable manner by linear actuators, which linear actuators are electronically coupled to each other and to the rotational actuators that rotate the booms 13, in order to carry out the synchronized movement as described above. By coupling the movements of the four moving parts by means of a more complex processing device, the boat 2 can also be displaced along other more complex paths, one of which will be described next.

Figure 2B:
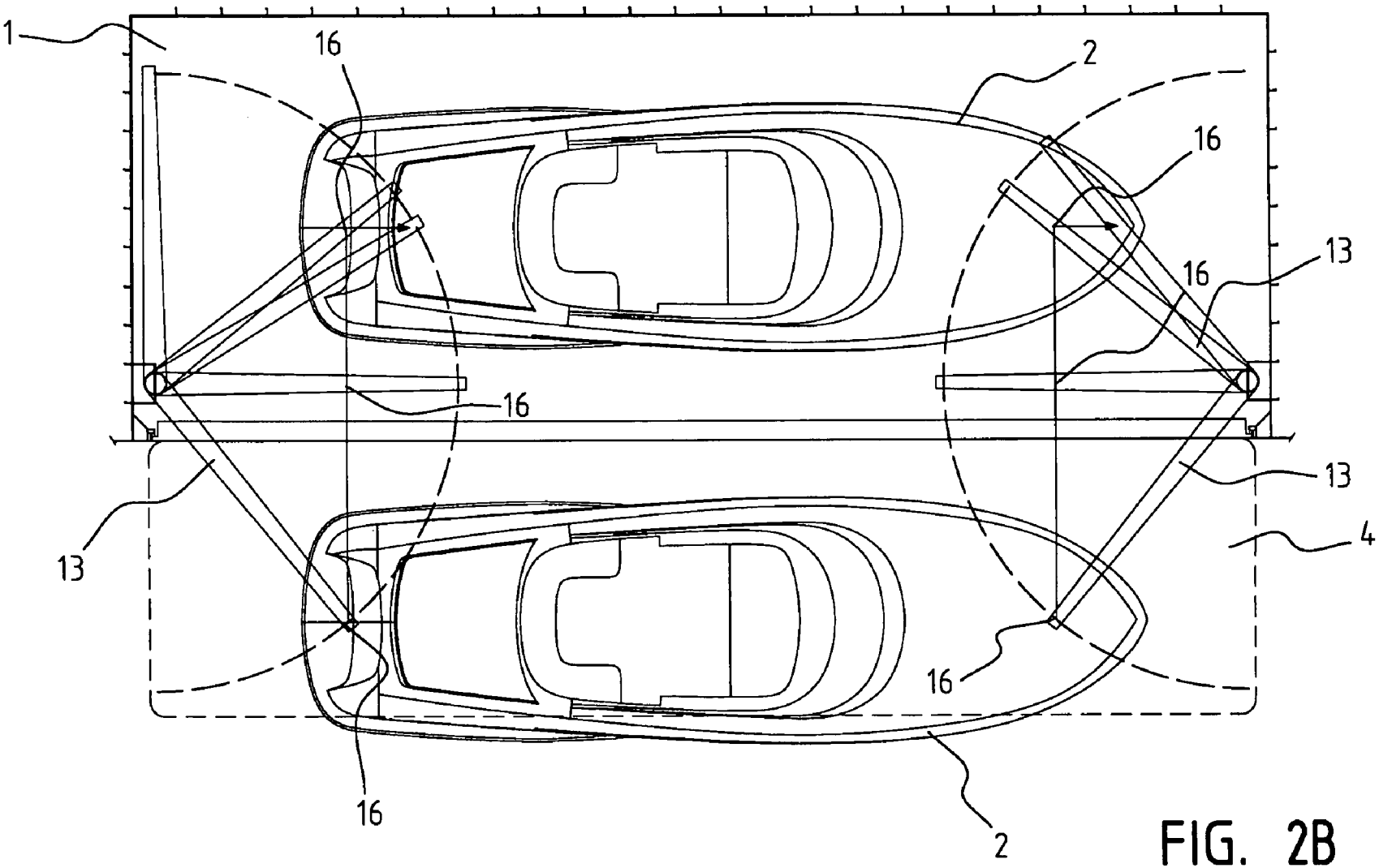
FIG. 2B schematically shows the assembly of FIG. 1 in top view, in four different working positions while hauling the boat in, and subsequently moving the boat forward.

FIG. 2B shows in three different working positions how the boat 2 is hauled onboard, which is apparently the opposite movement as described above in relation with FIG. 2A. The figure also shows how the boat 2 is subsequently moved forward onboard. This is achieved by rotating the booms 13 in the same rotational direction at the same time, while moving the suspension frame 16 on the left boom towards the outer end, while moving the suspension frame 16 on the right boom towards the upright 5, such that both booms 13 move in the same direction over the same direction in a straight line. It will be appreciated that various kinds of displacements of the boat 2 can be achieved in this manner.

Figure 2C:
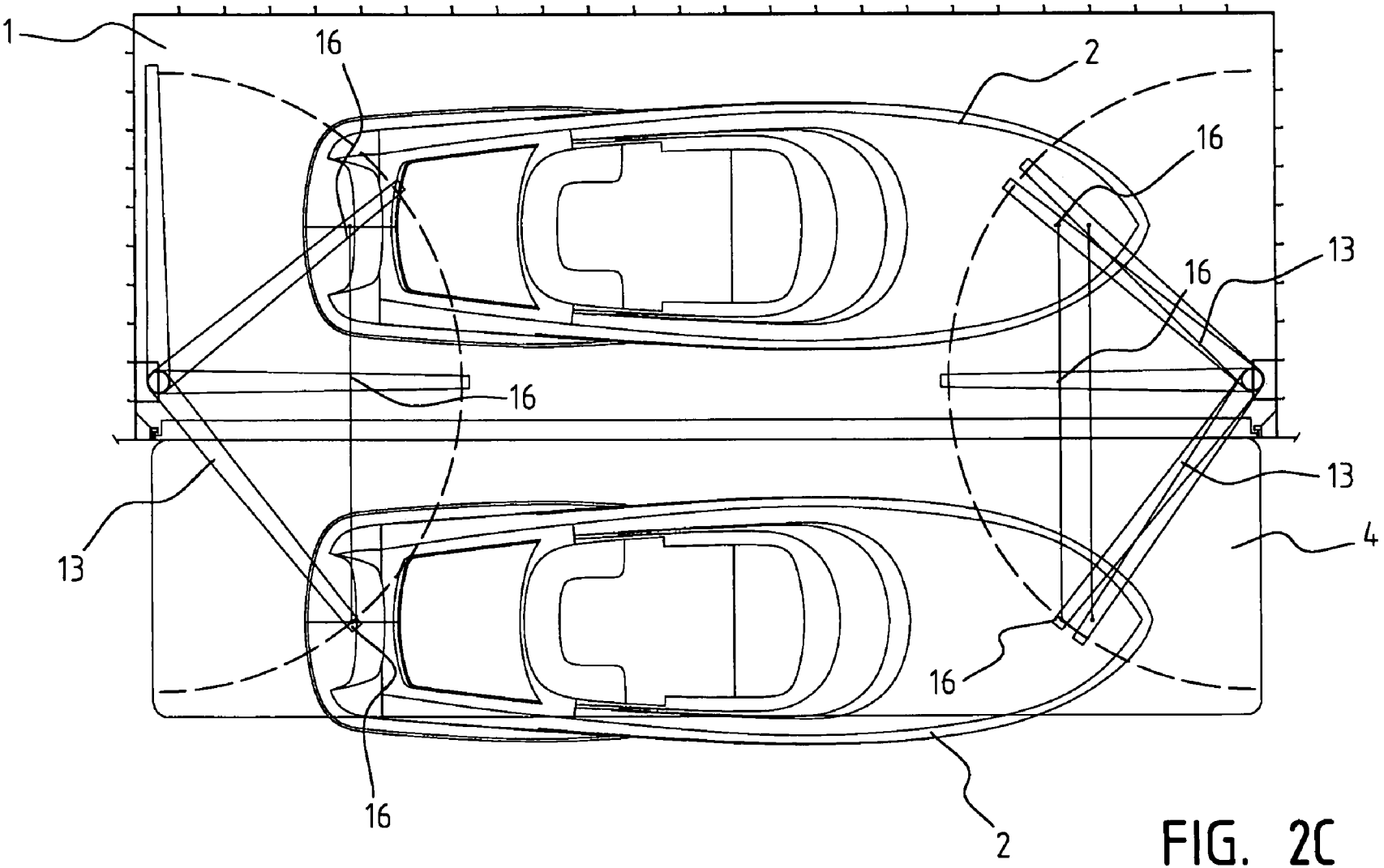
FIG. 2C schematically shows the assembly of FIG. 1 in top view, in three different working positions while launching the boat, with two alternative suspensions from the davit on the right.

FIG. 2C shows substantially the same as FIG. 2A, however with two alternative suspensions from the davit on the right. It can be seen therefrom that the location where the hoist 15 is attached to the boat 2 determines the required rotational movement of the boom 13 and the movement of the suspension frame 16 along the boom. It also shows that the left and right davit assemblies do not move in an identically mirrored fashion, but that the movement depends on the initial position of the suspension frames.

In FIG. 3 the suspension frame 16 is shown at two different positions. The rotational actuators comprise a first electrical motor 33 and a planetary slewing drive 18, and is housed in the lower stationary part 6 of each upright 5. The shaft of the actuator is coupled to the axis of the rotating part 7 of the upright 5.

The linear actuator comprises a second electrical motor 19 which is housed in the rotating part 7 of the uprights 5. The second electrical motor 19 drives a toothed drive wheel 20, on which wheel 20 a tooth belt 21 is stretched. The two outer ends of the belt 21 are attached to the suspension frame 16, which comprises a frame having two front running wheels 22 and two back running wheels 23, such that it can ride on two parallel guide rails on the bottom of the hollow boom 13. Said belt 21 is further stretched on three toothed guide wheels 24, 25, 26, such that the suspension frame 16 can be moved between two of said guide wheels 24, 25, one near each end of the boom 13.

The hoist cable 15 is at one end attached to the outer end of the boom 13. From there it extends towards the suspension frame 16, where it is guided over a first sheave 27, which can freely rotate between the two front running wheels 22. From there the hoist cable 15 extends downwards and upwards again, carrying a hoist block 17 having a freely rotatable sheave 28 which is supported on the hoist cable 15. The hoist cable 15 extends further over a second sheave 29 of the suspension frame 16 which can rotate freely between the two back running wheels 23, and further over a sheave 30 near the axis of the rotating part 7 of the upright 5. From there it extends along the axis of the upright 5 towards a sheave 31 near the axis of the upper stationary part 8 of the upright 5, and further to a winch 32.

The invention claimed is:

1. Onboard davit assembly for launching a boat from a ship, comprising:

two spaced apart davits, each davit including a substantially horizontal boom, a hoist cable extending downwards from a suspension framed on the boom and including at least one fixation device at its lower end to which the boat is attachable, the booms being movable between an inward position in which the suspension frames extend inboard and an outward position in which the suspension frames extend outboard, the booms extending from an onboard vertical pivot axis and being rotatable in a horizontal plane around the pivot axis, the suspension frames being movable along the booms such that a distance between the suspension frames remains constant during rotation of the booms between the inward and outward positions when the boat is moved from a parking position to a launching position, wherein each boom is rotatable by a motor having a driving shaft, which is coaxial with the pivot axis.

2. Onboard davit assembly for launching a boat from a ship, comprising:

two spaced apart davits, each davit including a substantially horizontal boom, a hoist cable extending downwards from a suspension framed on the boom and including at least one fixation device at its lower end to which the boat is attachable, the booms being movable between an inward position in which the suspension frames extend inboard and an outward position in which the suspension frames extend outboard, the booms extending from an onboard vertical pivot axis and being rotatable in a horizontal plane around the pivot axis, the suspension frames being movable along the booms such that a distance between the suspension frames remains constant during rotation of the booms between the inward and outward positions when the boat is moved from a parking position to a launching position, wherein each suspension frame is movable by a motor driving a belt, the belt being connected to the suspension frame.

3. Davit assembly according to claim 2, wherein each boom is connected to an upright, at least a part of the upright to which the boom is connected being rotatable, and said motor is contained in the rotatable part of the upright.

4. Onboard davit assembly for launching a boat from a ship, comprising:

two spaced apart davits, each davit including a substantially horizontal boom, a hoist cable extending downwards from a suspension framed on the boom and including at least one fixation device at its lower end to which the boat is attachable, the booms being movable between an inward position in which the suspension frames extend inboard and an outward position in which the suspension frames extend outboard, the booms extending from an onboard vertical pivot axis and being rotatable in a horizontal plane around the pivot axis, the suspension frames being movable along the booms such that a distance between the suspension frames remains constant during rotation of the booms between the inward and outward positions when the boat is moved from a parking position to a launching position, wherein the hoist cable is fixed at one end near the outer end of the boom and is wound on an onboard reel at its other end, a central part of the hoist cable is suspended from the suspension frame in a U-shape, and the at least one fixation device includes a sheave supporting on the bottom of said U-shaped part of the cable.

5. Davit assembly according to claim 4, wherein the suspension frame includes two sheaves from which the hoist cable is suspended.

6. Onboard davit assembly for launching a boat from a ship, comprising:

two spaced apart davits, each davit including a substantially horizontal boom, a hoist cable extending downwards from a suspension framed on the boom and including at least one fixation device at its lower end to which the boat is attachable, the booms being movable between an inward position in which the suspension frames extend inboard and an outward position in which the suspension frames extend outboard, the booms extending from an onboard vertical pivot axis and being rotatable in a horizontal plane around the pivot axis, the suspension frames being movable along the booms such that a distance between the suspension frames remains constant during rotation of the booms between the inward and outward positions when the boat is moved from a parking position to a launching position, wherein the hoist cable is guided from the suspension frame to the pivoting axis of the boom by a sheave fixed to said pivoting boom, and from there, is guided along said pivoting axis to a non-pivoting sheave.

7. Onboard davit assembly for launching a boat from a ship, comprising:

two spaced apart davits, each davit including a substantially horizontal boom, a hoist cable extending downwards from a suspension framed on the boom and including at least one fixation device at its lower end to which the boat is attachable, the booms being movable between an inward position in which the suspension frames extend inboard and an outward position in which the suspension frames extend outboard, the booms extending from an onboard vertical pivot axis and being rotatable in a horizontal plane around the pivot axis, the suspension frames being movable along the booms such that a distance between the suspension frames remains constant during rotation of the booms between the inward and outward positions when the boat is moved from a parking position to a launching position, wherein both booms rotate at the same time in opposite directions in a mirrored fashion.

8. Onboard davit assembly for launching a boat from a ship, comprising:

two spaced apart davits, each davit including a substantially horizontal boom, a hoist cable extending downwards from a suspension framed on the boom and including at least one fixation device at its lower end to which the boat is attachable, the booms being movable between an inward position wherein the suspension frames extend inboard and an outward position wherein the suspension frames extend outboard, the booms extending from an onboard vertical pivot axis and being rotatable in a horizontal plane around the pivot axis, the suspension frames being movable along the booms such that a distance between the suspension frames remains constant during rotation of the booms between the inward and outward positions when the boat is moved from a parking position to a launching position, wherein each boom is rotatable by a motor having a driving shaft, which is coaxial with the pivot axis.

* * * * *